United States Patent [19]

Siegel

[11] 3,955,609

[45] May 11, 1976

[54] HANDBAG

[75] Inventor: Milton I. Siegel, Scottsdale, Ariz.

[73] Assignee: AMBA Marketing Systems, Inc., Tempe, Ariz.

[22] Filed: Sept. 16, 1975

[21] Appl. No.: 613,896

[52] U.S. Cl. ..... 150/35; D87/3 F; 150/39

[51] Int. Cl.[2] ..... A45C 3/06; A45C 1/08

[58] Field of Search ..... 150/30, 34, 35, 39, 150/42, 1.6; D87/3 R, 5 E, 5 G

[56] References Cited

UNITED STATES PATENTS

| | | | |
|---|---|---|---|
| 587,251 | 7/1897 | Wilentshik | 150/34 |
| 1,560,442 | 11/1925 | Trowbridge | 150/28 R |
| 1,793,899 | 2/1931 | Benforado | 150/34 |
| 2,417,322 | 3/1947 | Plotsky | 150/35 |
| 2,612,199 | 9/1952 | Schocket | 150/30 |
| 3,001,566 | 9/1961 | Lipsitz | 150/12 |
| 3,435,868 | 4/1969 | Stermer | 150/39 |
| D235,690 | 7/1975 | Barad | D87/3 F |
| D235,691 | 7/1975 | Barad | D87/3 F |

*Primary Examiner*—Herbert F. Ross
*Attorney, Agent, or Firm*—Drummond, Nelson & Ptok

[57] ABSTRACT

A ladies handbag is provided with an external flap on either side thereof. Each flap is hingedly affixed to lie in juxtaposition against the respective side of the handbag when closed. One flap opens to reveal tiers of document stowage pockets carried on the side of the handbag. A plurality of transparent document enclosures are arranged upon an interior side of the other flap. One flap is hingedly attached along the top thereof while the other flap is secured on the bottom thereof. A patch pocket may be affixed to the external side of a flap.

5 Claims, 9 Drawing Figures

FIG. 1
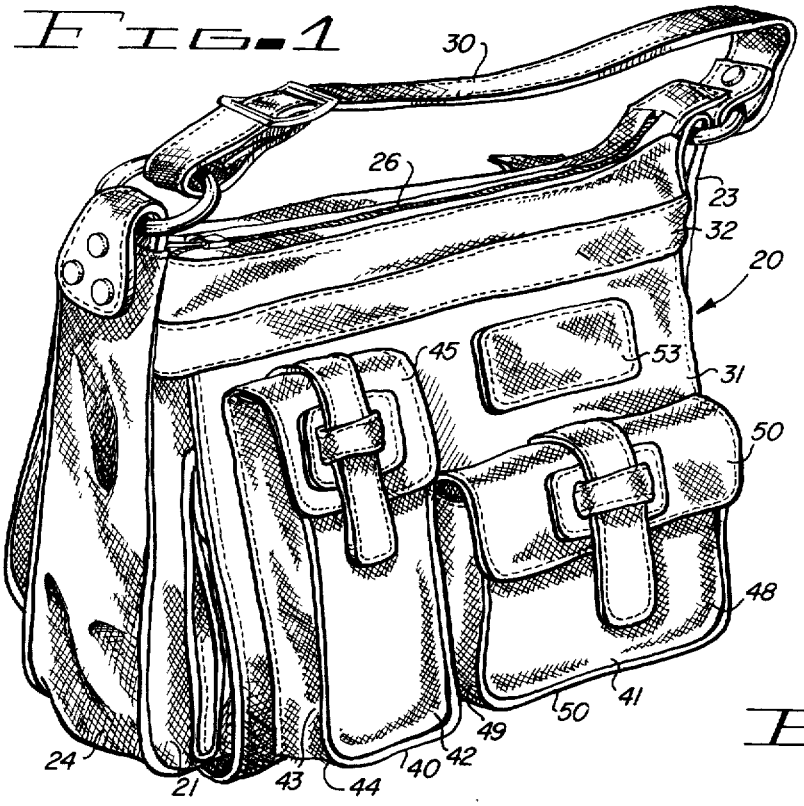
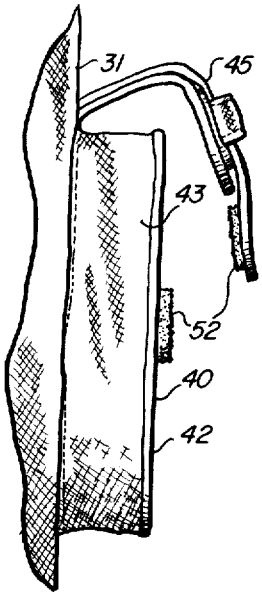
FIG. 2
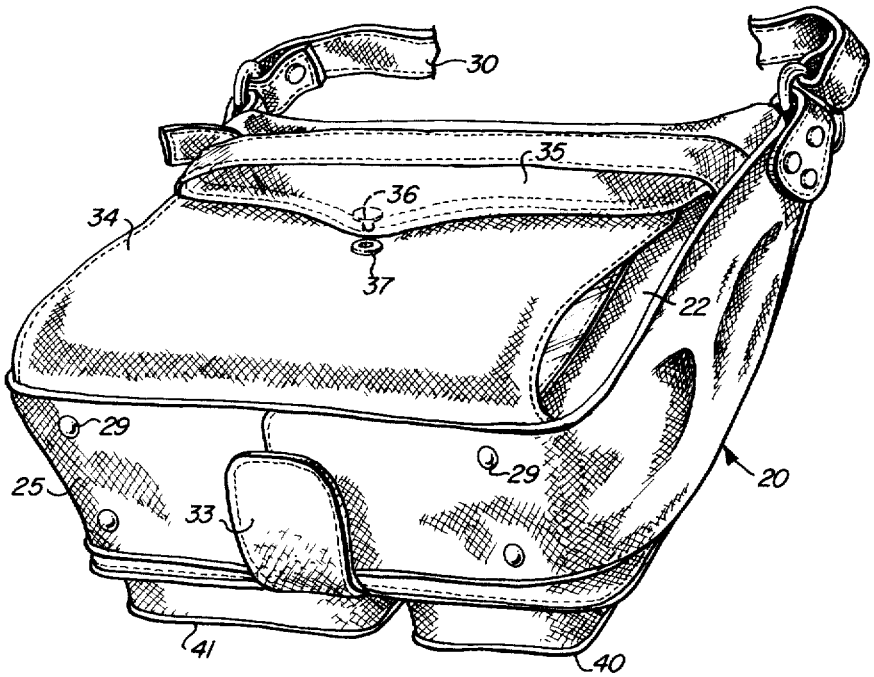
FIG. 3

HANDBAG

This invention relates to ladies handbags.

More particularly, the present invention concerns a compartmentalized handbag providing for the orderly arrrangement of profuse personal affects.

In a further aspect the instant invention concerns a compartmentalized handbag having specialized facilities for readily accessible stowage of various personal documents such as credentials and memorabilia.

Carrying a handbag is a well-established female tradition. Most women consider a handbag or purse not as an accessory item but rather as a necessity of comparable magnitude to clothes. The handbag is carried everywhere. Like clothing numerous styles and designs of handbags are available to satisfy individual aesthetic preferences and to compliment the purpose or occasion. Many women own several handbags frequenly changing from one to the other to match the style with the occasion or the color with the dress.

Most women are in continuous need of all manner of paraphenalia to support their daily activities. This paraphenalia including credit cards, photographs, credentials, glasses, checkbook, wallet, change purse, keys, stamps, note paper, phone number listings, facial tissues, etc., is conventionally carried in the handbag. To accommodate this need manufacturers have provided a prior art that is replete with various sizes, shapes and designs. Yet, most of the above items generally lie in entangled profusion at the bottom of the purse; much to the dismay of the female urgently trying to retrieve a particular needed item.

Accordingly, it is a principle object of the present invention to provide a ladies handbag having improved utility.

Another object of the invention is the provision of a handbag which is arranged for the orderly stowage of numerous assorted personal paraphenalia.

Still another object of the invention is the provision of a handbag having means for systematic reference and availability of frequently used credentials.

Yet another object of the invention is to provide a handbag which includes a readily viewable arrangement of memorabilia.

A further object of the invention is the provision of the methodical, compartmentalized safe-keeping of various documents within a ladies handbag.

And a further object of the instant invention is to provide a handbag in which the profusion of belongings generally needed and required by females to sustain everyday activity may be conveniently and systematically carried and is readily accessible.

And yet a further object of the present invention is the provision of a handbag of the above type which is relatively unencumbered, inexpensive to manufacture, and aesthetically pleasing.

Briefly, to achieve the desired objectives of the present invention in accordance with a preferred embodiment thereof, provided is a ladies handbag having an open top compartment therein formed by side and bottom panels. A document carrier for the orderly stowage of indicia bearing instruments, credentials and memorabilia includes a flap hingedly affixed to the handbag. Retention means are provided for selectively retaining the flap in a closed position in juxtaposition with a side panel of the handbag. In the opened position the flap extends angularly from the side panel and exposes document stowage means carried on the inside of the flap.

In a further embodiment the compartment is provided with a flap on either side thereof and additional document stowage means carried by the exterior side of the side panels. The document stowage means can assume several forms. In one configuration the document stowage means includes tiered rows of pockets for receiving and holding credentials such as credit cards. Alternately, memorabilia such as photographs are held and displayed in a pattern of transparent enclosures.

The foregoing and further and more specific objects and advantages of the present invention will become readily apparent to those skilled in the art from the following detailed description thereof taken in conjunction with the drawings in which:

FIG. 1 is an upper three quarter perspective view generally illustrating the obverse side of a ladies handbag constructed in accordance with the teachings of the present invention;

FIG. 2 is a fragementary end view of the handbag of FIG. 1;

FIG. 3 is a lower perspective view generally depicting the reverse side of the handbag of FIG. 1;

Figure 4:
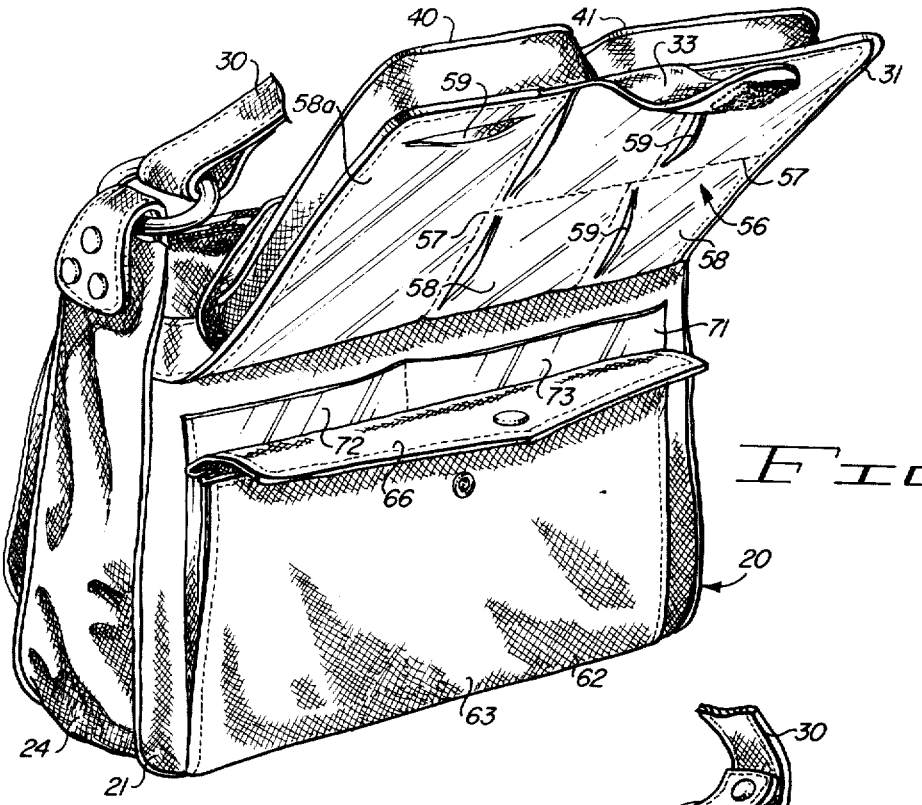
FIG. 4 is a perspective view generally corresponding to the view of FIG. 1 except having the external side flap thereof illustrated in the open position to reveal the document carrier associated therewith.

Turning now to the drawings in which the same reference numerals indicate corresponding elements throughout the several views attention is first directed to FIGS. 1 and 3 which illustrate a ladies handbag fabricated in accordance with the teachings of the present invention as it would appear from the obverse side and reverse side, respectively. The terms "obverse" and "reverse" are used herein to establish a frame of reference for further description and discussion of the handbag as the specification proceeds. A central compartment as will be hereinafter shown in detail, is formed by obverse side panel 21, reverse side panel 22 end panels 23 and 24 and bottom panel 25. As specifically illustrated in accordance with preferred aesthetic considerations, end panels 23 and 24 are integral with and form extensions of bottom panel 25. Zipper 26 provides closure means for the compartment thus formed.

Buttons 29 carried on the underside of bottom panel 25 provide rest points for handbag 20 and protect the surface finish of bottom panel 25. Carrying strap 30 is secured at either end thereof to the respective end panels 23 and 24. A further explanation of carrying strap 30 will be made presently. As will be immdiately apparent to those skilled in the art handbag 20 is fabricated from various material such as leather or vinyl and is either sewn, heat bonded or otherwise assembled in accordance with the established techniques of the art.

A flap 31 is hingedly affixed along the upper edge thereof to handbag 20 and in the closed position as illustrated in FIG. 1 lies in juxtaposition with obverse panel 21. Reinforcing strip 32 lies over the upper edge of flap 31 and is secured to obverse panel 21 and flap 31 to reinforce the hinge and aesthetically disguise the upper edge of flap 31. Tab 33 extends from the lower edge of flap 31 and provides means for retaining flap 31 in the closed position as will be hereinafter described in greater detail. Flap 34 lies in juxtaposition with reverse side panel 22 when in the closed position as better seen in FIG. 3. The lower edge of flap 34 is hingedly affixed into the seam between reverse side panel 22 and bottom panel 25. Retention flap 35 is hingedly affixed as by sewing to reverse side panel 22 and depends therefrom over flap 34. Snap fastener half 36 carried by retention flap 35 matingly engages snap fastener half 37 secured to flap 34 to hold flap 34 in the closed position.

Patch pockets 40 and 41 are carried on the external side of flap 31. Patch pocket 40 is formed by panel member 42 which is spaced from flap 31 by side and bottom members 43 and 44, respectively. Closure member 45 is hingedly affixed to flap 31 and extends over the open top patch pocket 40. Similarly, patch pocket 41 includes panel member 48, side, bottom and cover members 49, 50 and 51, respectively. As seen in FIG. 2, closure member 45 is selectively secured to panel member 42 by closure means of the type sold under the trade name Valcro and designated by the reference character 52 herein. Closure member 50 is similarly made detachably secureable to panel member 48. Lamina 53 secured to flap 31 is used to bear the owener's initials, either inscribed therein or attached thereto.

Figures 8, 9:
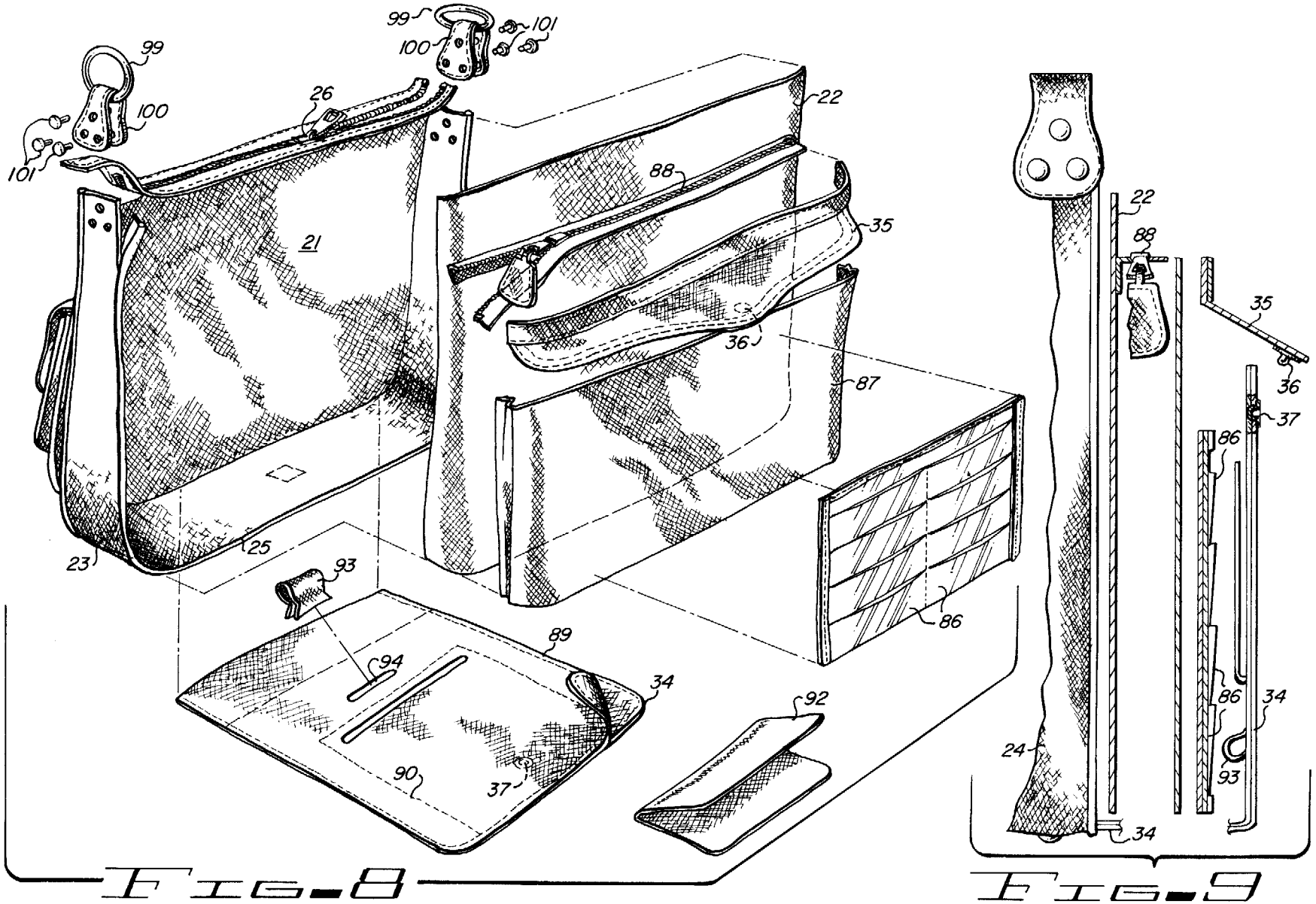
FIG. 8 is an exploded perspective view of the ladies handbag of the instaNt invention as viewed from the reverse side.
FIG. 9 is a fragementary vertical sectional view further illustrating the arrangement of elements as seen in FIG. 8.

With specific reference to FIGS. 4 and 8 it is seen that a document carrier is provided on the obverse side of handbag 20. Transparent sheet 56 is secured to the backside of flap 31 by a pattern of juncture seams 57 which divides the assembly into a plurality of see through enclosures 58. Each enclosure 58 has an elongate opening or slot 59 which extends through transparent sheet 56. Documents or indicia bearing instruments such as photographs are inserted through slots 59 to be contained and displayed within enclosures 58. For this purpose each enclosure 58 may be sized and shaped to correspond to the conventional size of a wallet or passport photograph. An elongate enclosure **58*a*** is particularly adapted to display a listing of frequently used telephone numbers.

An elongate pouch 62 especially useful for carrying letters, purchase receipts, prescriptions and similar documents is carried by panel 21. Pouch 62 is formed by a front panel member 63 which is secured to rear panel member 64 via accordion pleated end members 65. Flap 66 being the upper extension of rear panel member 64 forms the closure member for pouch 62 and carries female snap fastener half 67 which matingly engages male snap fastener half 68 carried by front panel member 63. Pouch 62 is secured along the lateral and bottom edges thereof to flap 31 forming a pocket therebetween. The pocket provides stowage for coupons, notes and similar items.

An elongate transparent strip 71 is attached along the the bottom and side thereof forming an elongate open top pocket. In accordance with the preferred embodiment the pocket formed by strip 71 is divided into a first compartment 72 and a second compartment 73. One compartment either 71 or 72 can be used to contain postage stamps while the other compartment is adapted for carrying trading stamps. The type and denomination of stamps are immediately discernible. Flap 31 and the document carrier enclosed thereby is retained in the closed position by mating patches of closure material as sold under the name Velcro. Mating Velcro elements 74 and 75 are carried, respectively, on the underside of bottom panel 25 and tab 33.

Figure 6:
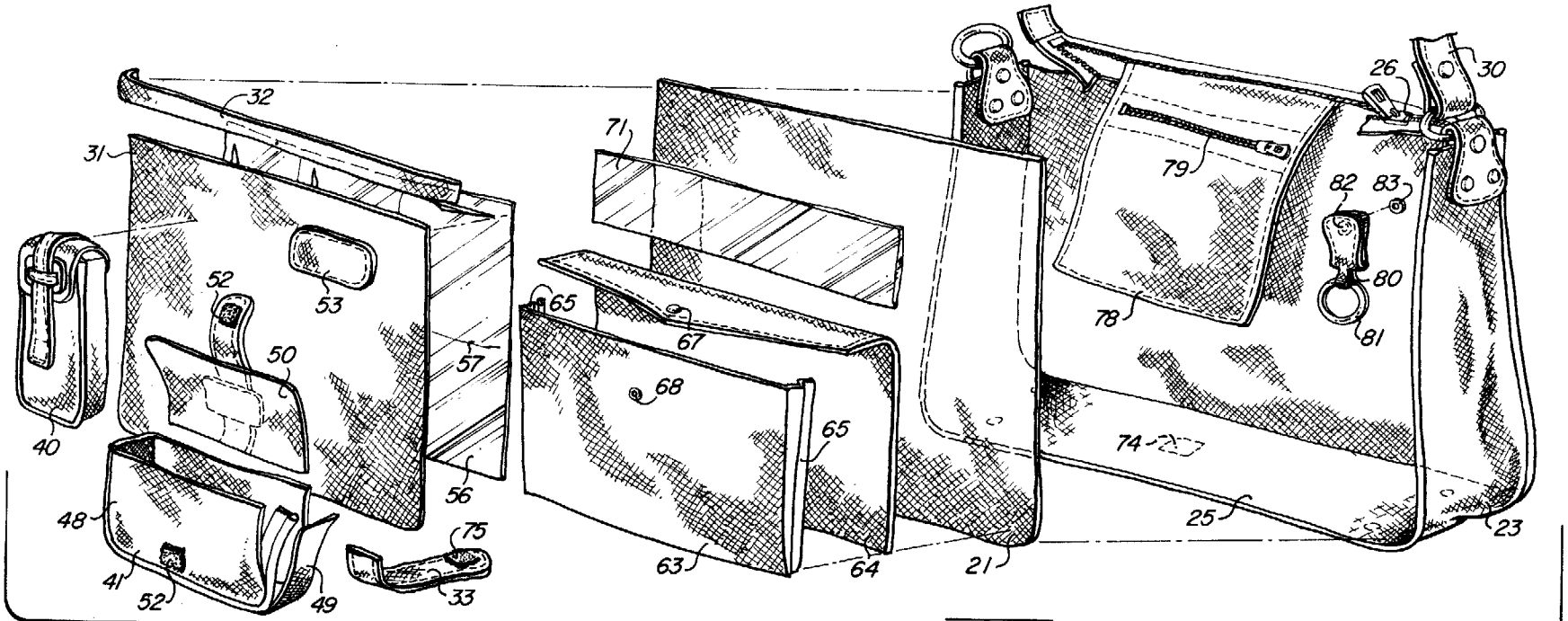
FIG. 6 is an exploded perspective view of the handbag of the instant invention as seen from the obverse side.

With particular reference to FIG. 6 it is noted that a flap pouch 78 accessible through zipper 79 is secured along the upper edge thereof to the interior side of reverse side panel 22 and depends downwardly therefrom into the central compartment. Flexible tab 80 having key ring 81 depending therefrom is provided with a snap fastener half 82 which matingly engages snap fastener half 83 carried on the interior side of reverse side panel 22.

Figure 5:
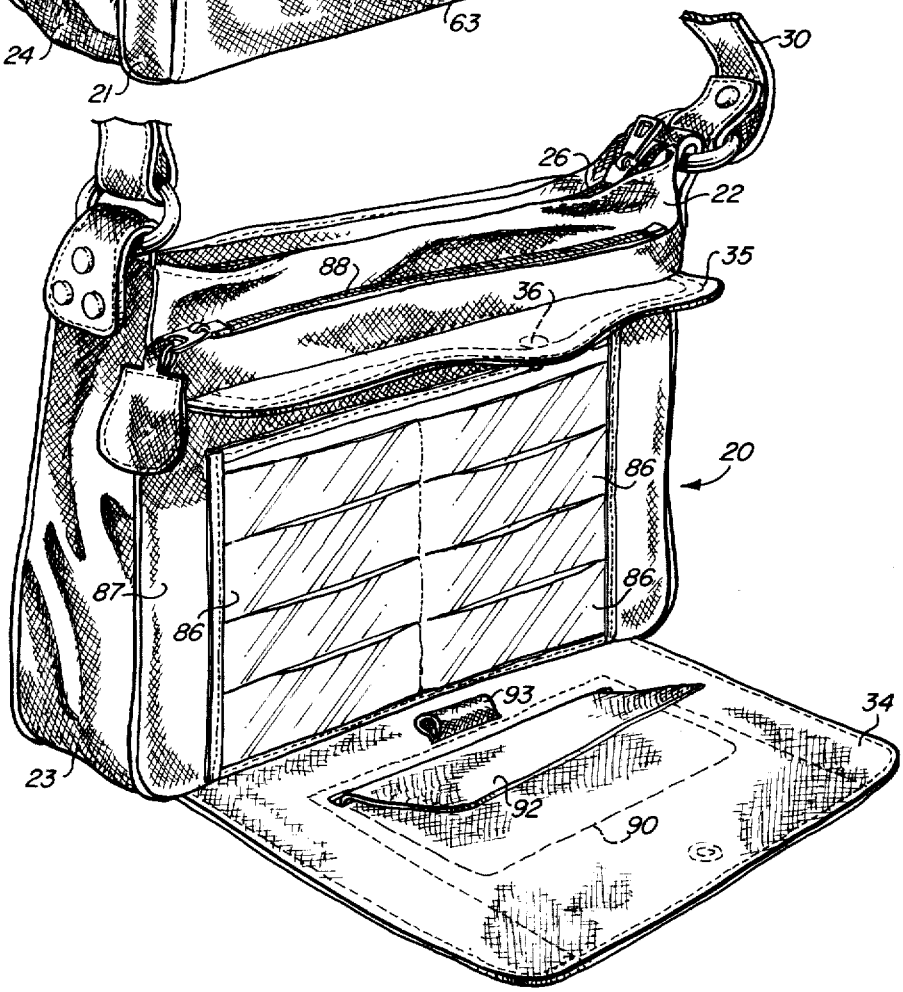
FIG. 5 is an upper threee quarter perspective view of the reverse side of the purse of the instant invention and showing the document carrier associated therewith in the open position.

A document carrier integral with the reverse side of handbag 20 is particularly illustrated in FIGS. 5, 8 and 9. Flap 34 folds downwardly to reveal a tiered arrangement of transparent pockets 86. Each pocket is sized and shaped to receive the lower end of an identification or credit card. Due to the tiered arrangement of pockets 86 the cards are held in overlapping fashion such that each card is immediately identifiable and accessible when flap 34 is opened.

Pockets 86 are secured to an intermediate panel 87 which is secured along the edges and bottom thereof to reverse panel 22 forming a compartment therebetween. Zipper 88 is secured along one side to the upper edge of panel 87 and secured along the other side to reverse panel 22 to provide closure means for the intermediate compartment.

Lamina or lining 89 is secured to the backside of flap 34 preferably by sewing about the periphery thereof. Additional sewing along the dashed line 90 defines a pocket area between flap 34 and lining 89 which is accessible through elongate slot 91. A relatively thin sheet member may be inserted through slot 91. Accordingly, the back cover of a conventional checkbook can be inserted through slot 91 for convenient carrying yet for ready access to the checks which are carried on the face surface of lining 89. Alternately, a folded pocket pouch 92 can be carried in an analogous manner with loose checks or other papers carried therein. A looped piece of flexible material 93 is inserted through slot 94 in lining 89 and secured between lining 89 and flap 34 to provide a pen or pencil holder. It is particularly noted that flap 34 is hingedly affixed along the bottom thereof to form a "drop panel" which will lie flat upon the surface upon which handbag 20 is resting to form a desk-like accommodation whereby checks may be written without removing the checkbook from slot 91.

Figure 7:
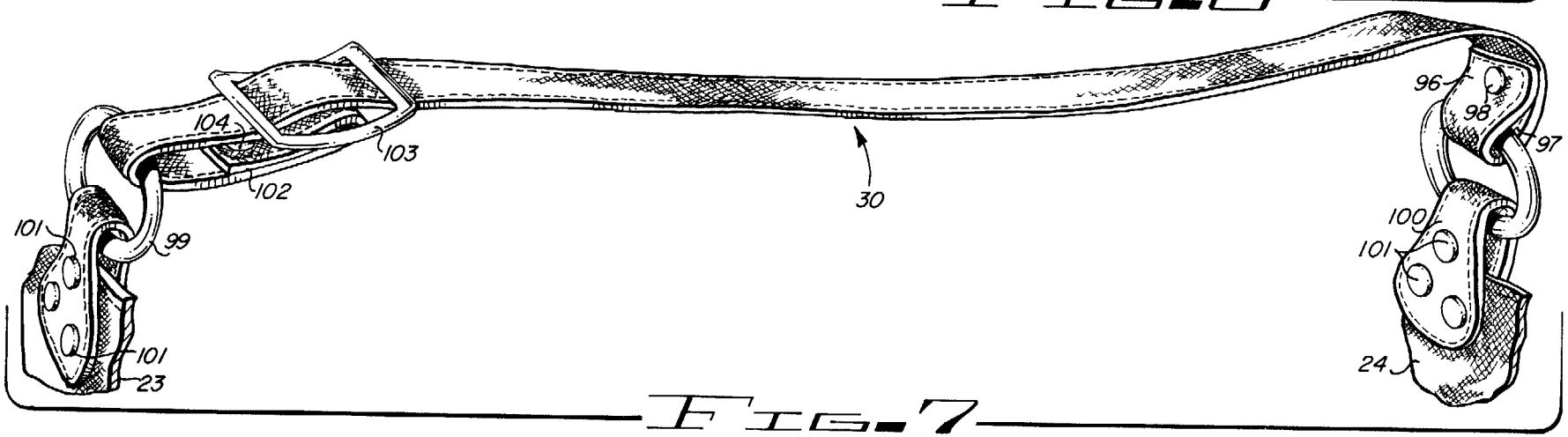
FIG. 7 is a perspective view of a preferred embodiment of a carrying strap for use in combination with the handbag of the instant invention.

Referring to FIGS. 7 and 8 it is seen that one end 96 of carrying strap 30 is doubled back to form loop 97 and secured with rivet 98. A ring 99 passes through loop 97 and is secured to end panel 24 by double tab 100 with rivets 101. Similarly, second end 102 of strap 30 passes through another ring 99 and is secured to the upper edge of side panel 23 with doubled tab 100 and rivets 101. End 102 is redoubled to engage adjusting buckle 103 and secured with rivet 104. The use of buckle 103 to provide a carrying strap of adjustably selective length is well known in the art.

Various changes and modifications in the embodiment herein chosen for purposes of illustration will readily occur to those skilled in the art. For example, the handbag hereinbefore described includes a document carrier on either side thereof. It is immediately apparent to provide a handbag including only one of the document carriers. Further, in view of the foregoing disclosure either of the document carriers can be readily adapted to handbags of alternate configuration.

Having fully described and disclosed the present invention and the preferred embodiment thereof in such clear and concise terms as to enable those skilled in the art to understand and practice same the invention claimed is:

1. A handbag comprising:

a body having first and second side panels joined to bottom and end panels to form a compartment, a first flap hingedly affixed to said first side panel substantially near the upper horizontal edge thereof and movable between a closed position in juxtaposition with said first side panel and an open position extending angularly from said first side panel, said first flap having dimensions selected to cause said first flap to substantially completely overlie said first side panel in said closed position of said first flap, first storage compartment means on at least one of the outside of first side panel or said first flap on the side thereof adjacent said first side panel, external storage means carried by the exterior side of said first flap, a second flap hingedly affixed to said second side panel substantially at the lower horizontal edge thereof and selectively movable between a closed position in juxtaposition with said second side panel and an open position extending angularly from said second side panel, the dimensions of said second flap selected to cause said second flap to substantially completely overlie said second side panel in the closed position of said second flap, second storage compartment means on at least one of the outside of said second side panel or said second flap on the side thereof adjacent said second side panel, said first or second storage compartment means comprising a plurality of pocket means, each of said pocket means having an opening for removably receiving documents therein, said pocket means being at least partially offset from one another to permit access to documents therein whenever said second flap is in the open position thereof, said second flap concealing said pocket means where said flap is in the closed position thereof, first and second retention means for selectively retaining said first and second flaps, respectively, in said closed position, and carrying strap means attached to said body for carrying the handbag in hand or over a shoulder.

2. The combination according to claim 1 wherein said first retention means includes a tab extending from said first flap and having fastening means thereon engageable with fastening receiving means carried on the bottom panel of said handbag.

3. The combination according to claim 1 wherein said external storage means on the outside of said first panel includes at least one external pocket carried by the exterior side of said first flap when said first flap is in the closed position thereof, said external pocket including:

a panel member substantially parallel to said first flap and spaced therefrom;

side and bottom members extending between the exterior side of said first flap and said panel member; and a closure member hingedly affixed to said first flap and extendible therefrom over the top of said external pocket and detachably securable to said panel member.

4. The combination according to claim 3 wherein said second storage compartment means comprises at least one pocket formed of transparent material affixed to the outside of said second side panel and further includes a second pocket on said second flap on the side thereof adjacent said second side panel when said second flap is in the closed position thereof; and said first storage compartment means comprises at least a third pocket secured to the outside of said first side panel, said third pocket being exposed with said first flap in the open position and concealed with said first flap in the closed position thereof.

5. The combination according to claim 4 wherein said first storage compartment means further includes a transparent sheet in juxtaposition with the side of said first flap adjacent said first side panel with said first flap in the closed position thereof, a pattern of junctive seams securing said transparent sheet to said first flap for dividing the assembly formed thereby into a plurality of enclosures, and slit means associated with each said enclosure for selectively receiving a document therethrough, so that documents placed within said enclosures may be selectively displayed with said first flap in the open position thereof.

* * * * *